United States Patent [19]

Ohtsuka

[11] Patent Number: 5,062,435

[45] Date of Patent: Nov. 5, 1991

[54] HAIR COMB WITH ABSORBANT PAD

[75] Inventor: Hiroshi Ohtsuka, Shizuoka, Japan

[73] Assignee: Hapyo Yugen Kaisha, Shizuoka, Japan

[21] Appl. No.: 551,473

[22] Filed: Jul. 12, 1990

[30] Foreign Application Priority Data

| | | | |
|---|---|---|---|
| Jul. 31, 1989 | [JP] | Japan | 1-90896[U] |
| Jul. 31, 1989 | [JP] | Japan | 1-90897[U] |
| Jul. 31, 1989 | [JP] | Japan | 1-90898[U] |
| Jul. 31, 1989 | [JP] | Japan | 1-90899[U] |

[51] Int. Cl.[5] ..... A45D 24/16

[52] U.S. Cl. ..... 132/108

[58] Field of Search ..... 132/108, 109, 110, 111, 132/119, 120, 126, 148, 150

[56] References Cited

U.S. PATENT DOCUMENTS

| | | | |
|---|---|---|---|
| 633,457 | 9/1899 | Hotze | 132/111 |
| 1,039,982 | 10/1912 | Maley | 132/110 |
| 1,169,028 | 1/1916 | Grove | 132/111 |
| 1,833,293 | 11/1931 | Laguionie | 132/150 X |
| 2,599,115 | 6/1952 | Lovegrove | 132/110 |
| 2,761,459 | 9/1956 | Kaul | 132/109 |
| 2,946,072 | 7/1960 | Filler et al. | 128/62 A X |
| 4,013,086 | 3/1977 | Chmela | 132/110 |

FOREIGN PATENT DOCUMENTS

| | | |
|---|---|---|
| 0630539 | 12/1927 | France . |
| 0928343 | 11/1947 | France . |
| 95606 | 7/1980 | Japan . |
| 101028 | 8/1981 | Japan . |
| 48855 | 3/1982 | Japan . |
| 154711 | 10/1983 | Japan . |
| 192727 | 12/1986 | Japan . |
| 45617 | 3/1988 | Japan . |
| 99530 | 6/1988 | Japan . |

*Primary Examiner*—John J. Wilson
*Assistant Examiner*—Jeffrey A. Smith
*Attorney, Agent, or Firm*—Spencer & Frank

[57] ABSTRACT

A hair treating device comprising a comb body and at least one elastic porous absorbing member. The comb body has at least one row of comb teeth and the elastic porous absorbing member has teeth formed of concave and convex portions. The pitches between neighboring teeth of the elastic porous absorbing member are sufficiently wider than those between neighboring comb teeth of the comb body. The elastic porous absorbing member is connected with the comb body connecting structure which supports the elastic porous absorbing member at the outside of and in parallel with the row of comb teeth.

7 Claims, 5 Drawing Sheets

HAIR COMB WITH ABSORBANT PAD

BACKGROUND OF THE INVENTION

The present invention relates to a new hair treating device comprising a comb and an elastic sponge type porous absorbing member which can absorb water and also remove water from hair.

Many proposals have been made for hair cleaning devices and/or hair treating devices using the combination of a sponge, a comb and/or a brush. For example:

(1) Japanese Utility Model Application Laid-Open No. 95606/1980 shows a hair dye comb device in which a sponge is put between thin metal plates of a comb.

(2) Japanese Utility Model Application Laid-Open No. 101028/1981 shows a sponge put between a brush or two combs.

(3) Japanese Utility Model Application Laid-Open No. 48855/1982 shows a brush comprising a body member and a brush and a sponge attached to both sides of the body.

(4) Japanese Utility Model Application Laid-Open No. 154711/1983 shows a comb at the back side of which a sponge having a hair treating agent impregnated therein is attached.

(5) Japanese Utility Model Application Laid-Open No. 192727/1986 shows a brush having a central body plate and a brush and a sponge attached to each side of the body plate. The body plate has many through-holes with which cleaner or hair treating agent contained in the sponge is supplied to the brush.

(6) Japanese Utility Model Application Laid-Open No. 45617/1988 shows a car washing brush comprising a body member and a brush and a sponge attached to each side of the body.

(7) Japanese Utility Model Application Laid-Open No. 99530/1988 shows a brush with a sponge in which cleaner may be impregnated.

In the above applications (3), (4), (5) and (6) a sponge and a comb (or brush) may selectively be used.

In these devices, cleaner or hair dye may be contained in a sponge, or alternatively the sponge can absorb the used cleaner from the hair.

In the applications (1), (2), and (7), the sponge and the comb or brush may be used together.

An object of the present invention is to provide an improved hair treating device of the type having a sponge (or sponges) and a comb that may be used together, for reforming disorderly hair after the user has been sleeping, or for use in applying a rinse after washing the hair or in removing water from the hair.

Another object of the present invention is to provide a hair treating device in which an elastic porous absorbing member is exchangeable with another.

A further object of the present invention is to provide a hair treating device, in a variety of types in combination with an elastic porous absorbing member in a variety of types according to the intended use.

SUMMARY OF THE INVENTION

A hair treating device according to the present invention comprises: (a) a body having at least one row of comb teeth; (b) at least one elastic porous absorbing member having a row of teeth formed by concave and convex forms and having a wider pitch between neighbouring teeth than that of the comb teeth; and (c) a connecting structure for supporting the elastic porous absorbing member at an outer side of the row of comb teeth and in parallel therewith.

A tooth of the elastic porous absorbing member of the hair treating device according to the present invention is a trapezoid and its root is wider than its tapered end portion. The root of the elastic porous absorbing member is positioned somewhat higher than a base of the comb tooth.

The connecting structure of the hair treating device according to the present invention comprises multiple rows of shafts, each of the shafts having a head provided at an outer side of the comb teeth. The elastic porous absorbing member has at least one row of engaging holes, which are smaller than the heads of the shafts. The elastic porous absorbing member is engageable with and detachable from the body.

The comb body of the hair treating device according to the present invention is made of synthetic resin. The shafts of the connecting structure for the elastic porous absorbing member are formed integrally with the body. In another embodiment the head portions of the connecting structure are formed separately and connected with the respective shaft portions.

The shaft portions of the connecting structure for the elastic porous absorbing member can also be formed separately from the body and be inserted into holes provided in the body and fixed there.

In a further variation the shaft portions of the connecting structure for the elastic porous absorbing member have respective heads bent at right angle with respect to the axis of the shaft portions.

The elastic porous absorbing member has rows of teeth on both sides thereof and in the center portion of the absorbing member there is a row of connecting holes.

The connecting structure for the elastic porous absorbing member in a further variation has grooves for receiving ends in the longitudinal direction of a thick plate member of the elastic porous absorbing member.

The connecting structure for the elastic porous absorbing member can further include protrusions which are to be engaged with grooves provided at ends in the longitudinal direction of the elastic porous absorbing member.

The connecting structure for the elastic porous absorbing member can be a slot or a step provided at one or both sides of the rows of comb teeth, and the elastic porous absorbing member can be fixed so that teeth thereof are in parallel with the rows of comb teeth.

DESCRIPTION OF THE PREFERRED EMBODIMENTS

The present invention will be explained in further detail with reference to the attached drawings.

Figure 1:
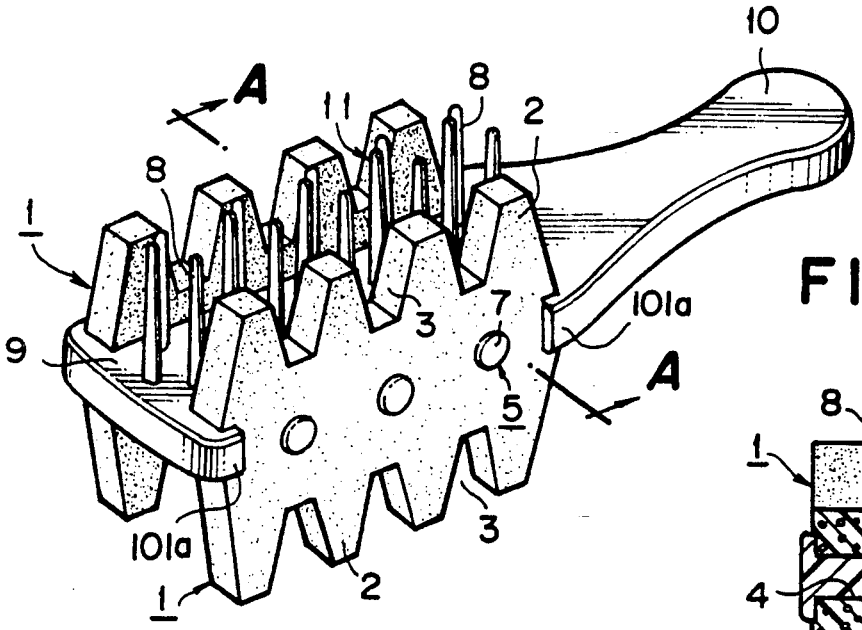
FIG. 1 is a perspective view showing a first embodiment of a hair treating device according to the present invention.
Figure 2:
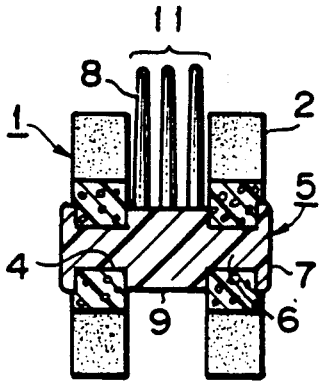
FIG. 2 is a cross-sectional view of the device taken along line, A—A of FIG. 1.

The first embodiment of the hair treating device according to the present invention will be explained mainly with reference to FIGS. 1, 2 and 4. FIG. 1 is a perspective view of the combination of two elastic porous absorbing members 1 and a body 9 connected by a connecting member. FIG. 2 is a cross-sectional view taken along line A—A of the first embodiment shown in FIG. 1.

A handle 10 is integrally provided with the body 9, and on one surface of body 9 project three rows of comb teeth 11.

On each side of the body 9 there are provided three headed or connecting pins 5 each having a head 7, the headed pins 5 forming the connecting member. Each of the headed pins 5 consists of a pin shaft 6 and a head 7 whose diameter is larger than that of the shaft 6.

The headed pins 5 are formed integrally with the abovementioned body 9 and the handle 10 by injection molding of synthetic resin material.

Figure 4:
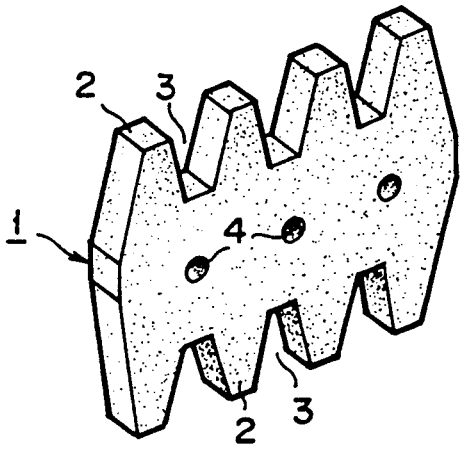
FIG. 4 is a perspective view showing a first embodiment of an elastic porous absorbing member used in the embodiment of FIGS. 1 and 3.

FIG. 4 is a perspective view of an elastic porous absorbing member 1 detached from the body 9.

Various materials may be used for the absorbing member 1, but a sponge urethane resin is suitable for the material.

In the embodiment shown in FIG. 4, the elastic porous absorbing member 1 has four teeth 2 on each of the upper and lower sides thereof, and in the center portion of the absorbing member 1 circular through-holes 4, 4, 4 are provided for being engaged with the connecting pins 5, 5, 5. The diameter of each of the holes 4, 4, 4 is almost the same as that of the pin shaft 6 of each of the headed pins 5 and smaller than that of each of the heads 7.

A gap 3 between neighbouring teeth 2 of the member 1 has a sufficiently wider pitch than that between the neighbouring comb teeth 8 of the body 9.

The roots of the teeth 2 are wide and the upper ends thereof are somewhat tapered, thus having the form of a trapezoid. The root or valley bottom of a tooth 2 is positioned somewhat higher than the bottom of a tooth 8 of the body 9.

Absorbing member 1 which is in the form of a sponge has elasticity and is easily reformable, and thus a user of the hair treating device can attach or detach it very easily.

Four holders 101*a*, one of which is not shown, are further provided on body 9 in order to hold the ends of the porous absorbing member 1.

Figure 3:
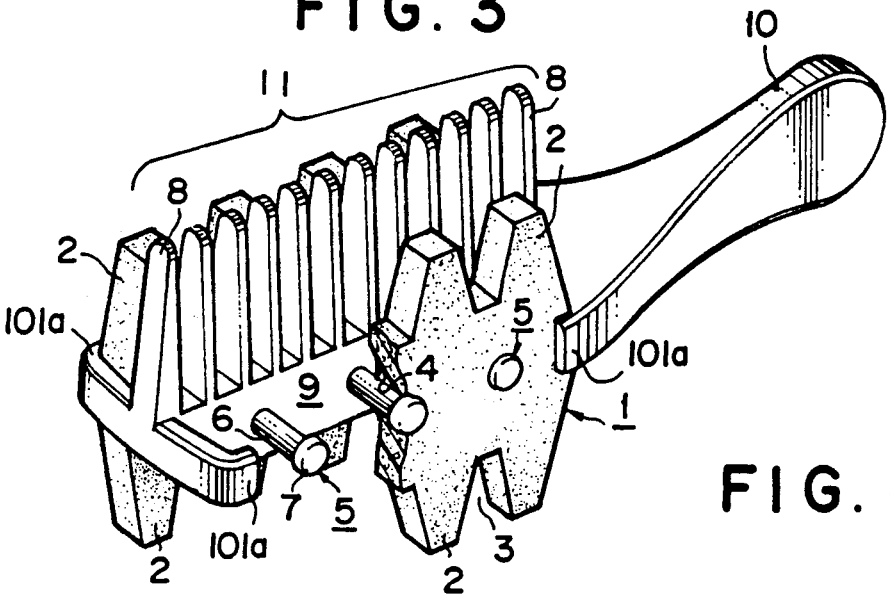
FIG. 3 is a perspective view of a second embodiment of a hair treating device according to the present invention, in which a part of an elastic porous absorbing member is broken away from the figure.

FIG. 3 is a perspective view of a second embodiment of the hair treating device according to the present invention. For easy understanding of the connecting structure, a part of the elastic porous absorbing member 1 is broken away.

The absorbing member 1 used in the device of FIG. 3 is the same as that shown and explained with reference to FIG. 4.

The embodiment of FIG. 3 is almost the same as that of FIGS. 1 and 2, except that only one row of comb teeth 11 is provided, and that the width of the body is somewhat narrower.

Figure 5:
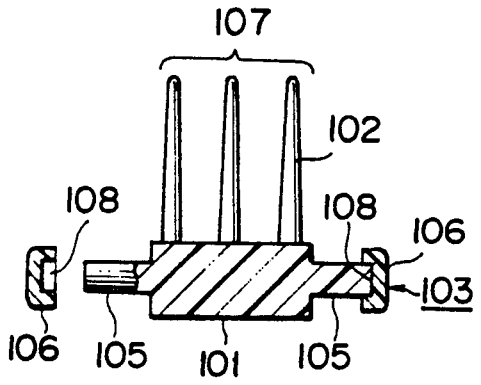
FIG. 5 is a cross-sectional view of another connecting structure of a body in the hair treating device of the first embodiment according to the present invention and an elastic porous absorbing member.

FIG. 5 is a cross-sectional view of another connecting structure for the elastic porous absorbing member of a body of the hair treating device according to the present invention.

In this embodiment, shaft members 105 constituting the connecting structure are integrally formed with a body 101 by molding.

Figure 6:
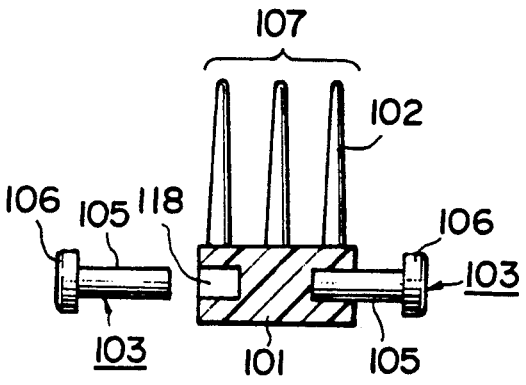
FIG. 6 is a cross-sectional view showing a further connecting structure of the body of the first embodiment of the hair treating device and the elastic porous absorbing member.

Outer ends of shaft members 105 are each connected with a button 106 having a concave portion 108, to form a connecting means 103. In FIGS. 5 and 6, 102 designates a comb tooth and 107 designates rows of comb teeth.

FIG. 6 is a cross-sectional view of a further modification of the connecting structure for the elastic porous absorbing member 1 of the first embodiment of the hair treating device according to the present invention. In this modification, a headed pin 103 is integrally formed with a head portion 106 and a shaft 105.

A receiving hole 118 is provided at each side of body 101, which receives and fixes headed pin 103.

Figure 7:
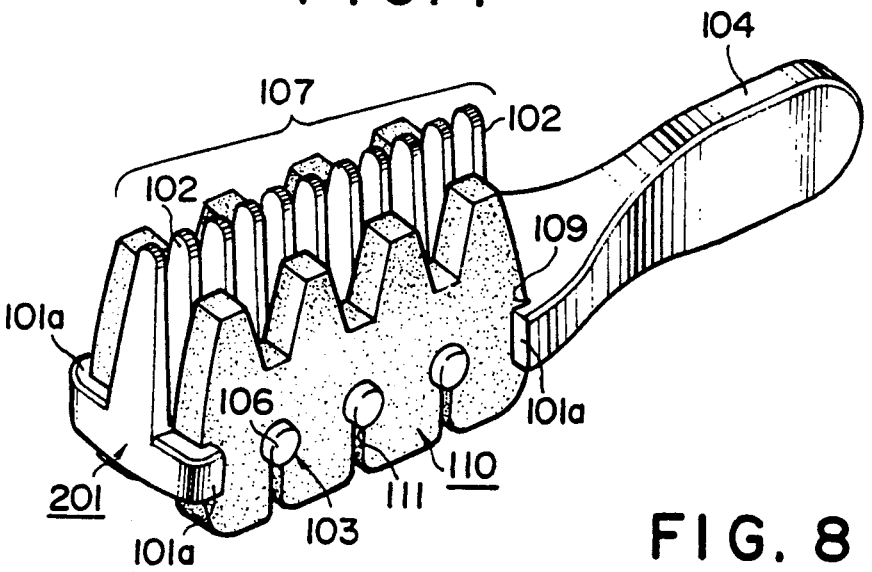
FIG. 7 is a perspective view showing a third embodiment of a hair treating device according to the present invention.
Figure 8:
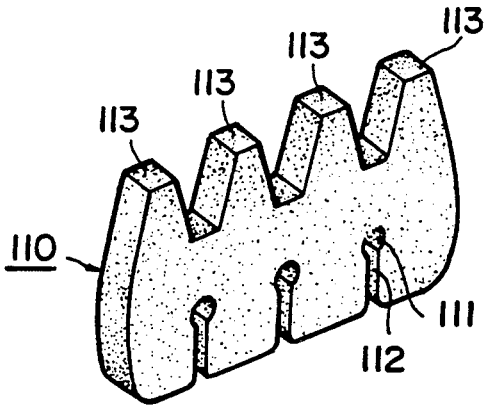
FIG. 8 is a perspective view of an elastic porous absorbing member used in the third embodiment of the hair treating device according to the present invention shown in FIG. 7.

FIG. 7 is a perspective view of a third embodiment of the hair treating device according to the present invention, which includes elastic porous absorbing members 110 shown in FIG. 8. In this embodiment, the structure of a body, a handle 104, a row of comb teeth designated 107 consisting of comb teeth 102; headed pins 103, 103 forming a connecting structure, elastic porous absorbing members, and holders 101*a* for holding ends of an elastic porous absorbing members 110 are the same as explained with reference to the above embodiments. A corner 109 adjacent holders 101*a* receives a part of absorbing member 110.

FIG. 8 is a perspective view of elastic porous absorbing member 110 used in the third embodiment of FIG. 7.

The material of the absorbing member 110 is the same as that of the above mentioned embodiments of the present invention. Teeth 113 are provided only at one side of member 110 the (upper side as viewed in the figure) and are in the form of trapezoids. The space between neighbouring teeth 113 is wider than that between neighbouring comb teeth 102.

Connecting holes 111 in this embodiment are formed as slots 112 at the lower side of the member 100 which does not have any teeth. In this embodiment, attaching and detaching of the elastic porous absorbing members 110 is done through slots 112, thus making the work of attaching easier. Therefore, the hair treating device of this embodiment is convenient for use when the elastic porous absorbing member is always used with the comb portion.

A fourth embodiment of the present invention is explained with reference to FIGS. 9~11.

The structure of much of the comb structure, etc. shown and explained with reference to the already mentioned embodiments is applicable to this embodiment. Therefore, the comb portion, particularly the comb teeth portion, is not shown in FIGS. 9–11, and an explanation here is drawn mainly to a connecting portion and an elastic porous absorbing member 201.

Figure 9:
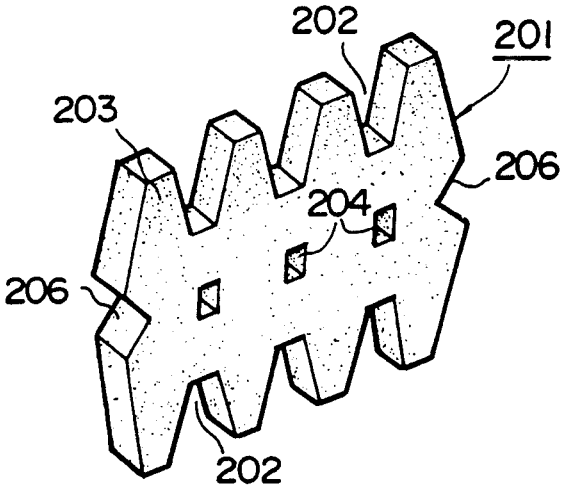
FIG. 9 is a perspective view of another embodiment of an elastic porous absorbing member having square connecting holes.

FIG. 9 is a perspective view of an embodiment of square hole connection type absorbing member 201.

Figure 10:
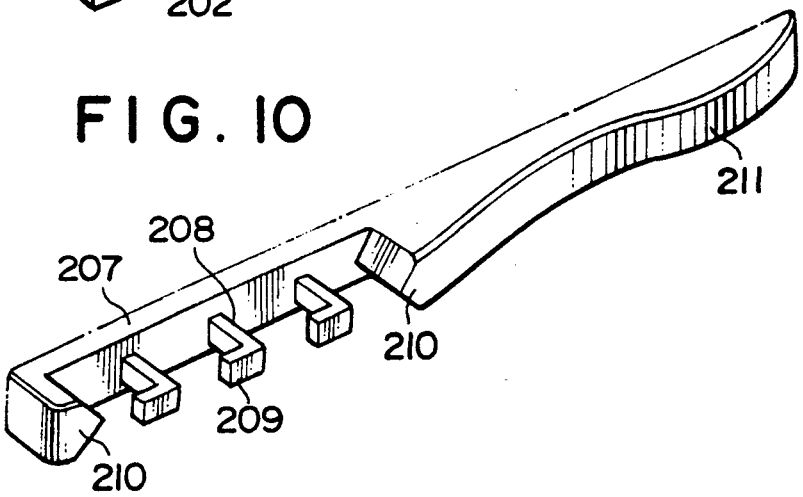
FIG. 10 is a perspective view of another embodiment of a receiving structure which receives an elastic porous absorbing member.
Figure 11:
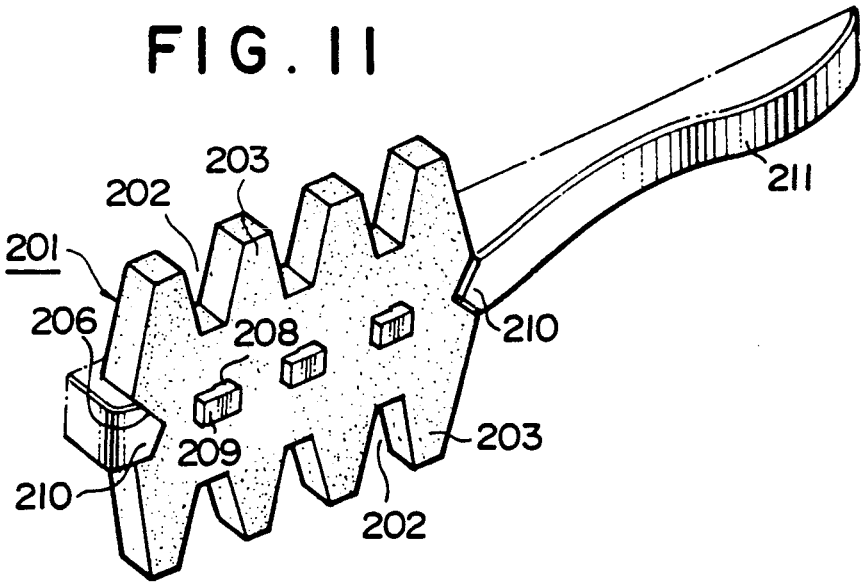
FIG. 11 is a perspective view showing a combined state of the absorbing elastic member shown in FIG. 9 and the receiving structure of FIG. 10 with the body of the hair treating device.

FIG. 10 is a perspective view of a fourth embodiment of a connecting structure for an elastic porous absorbing member having the square hole type connection. FIG. 11 is a perspective view showing the state of connecting the absorbing member shown in FIG. 9 with the comb body using connecting member 207 of FIG. 10.

In the embodiment, an elastic porous absorbing member 201 has trapezoid teeth 203 at upper and lower sides thereof and in the center portion thereof three square holes 204 disposed in the longitudinal direction of the member 201. A notch 206 is formed at each end of the member 201. There are gaps 202 between adjacent ones of teeth 203 in a manner similar to the gaps of the above-described embodiments.

At a side 207 of the body, the main portion thereof being not shown in FIG. 10, there are provided headed pins each consisting of square shaft 208 and a head 209. A handle 211 is provided as in the other embodiments.

At both of the forward and back ends of the body are respectively provided protrusions 210, 210 to be connected with the notches 206, 206 of the elastic porous absorbing member 201.

Figure 12:
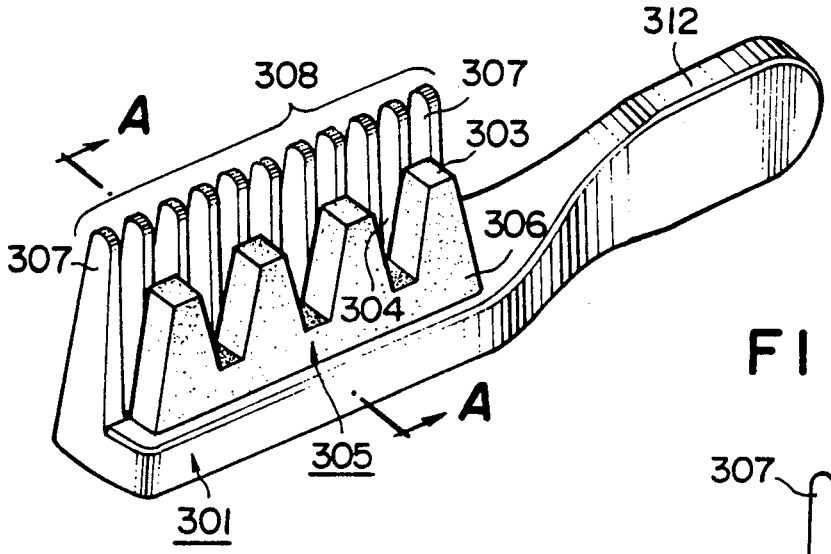
FIG. 12 is a perspective view showing a fourth embodiment of a hair treating device according to the present invention.

A fifth embodiment of the present invention is explained with reference to FIGS. 12, 13 and 16. This embodiment uses an elastic porous absorbing member 305 which has teeth 303 disposed along one side thereof whose structure is fully shown in FIG. 16. Gaps 304 are defined between adjacent ones of teeth 303. As shown in FIG. 12, in a comb body 301 a comb tooth row 308 consisting of comb teeth 307 is provided. A handle 312 is integrally provided with the body 301.

Figure 13:
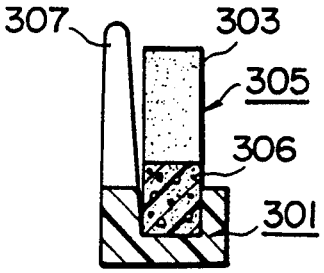
FIG. 13 is an A—A cross-sectional view of the fourth embodiment shown in FIG. 12.

As shown in FIG. 13, the body 301 has a groove in parallel with the comb tooth row 308, the groove receiving the elastic porous absorbing member 305. The member 305 is fixed in the groove with a bonding agent.

A sixth embodiment of the present invention will be explained with reference to FIGS. 14, 15 and 16.

Figure 14:
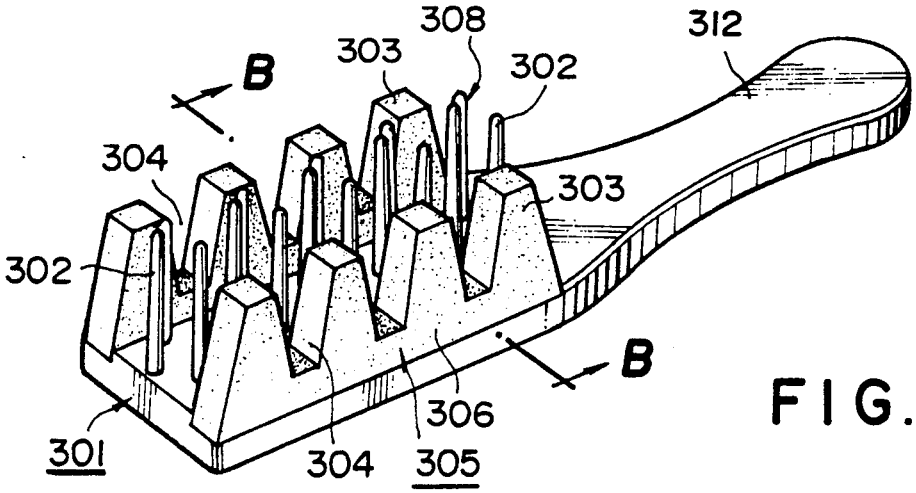
FIG. 14 is a perspective view showing a fifth embodiment of a hair treating device according to the present invention.
Figure 15:
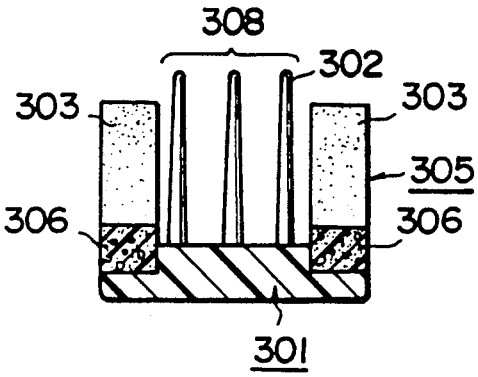
FIG. 15 is a cross-sectional view taken along the line B—B of the fifth embodiment shown in FIG. 14.
Figure 16:
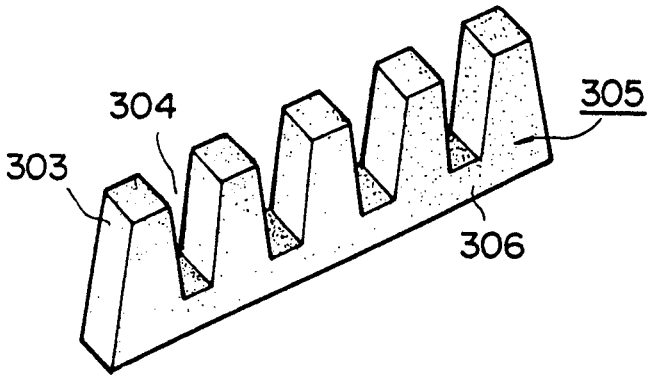
FIG. 16 is a perspective view showing an embodiment of the absorbing elastic member used in the fourth and fifth embodiments of the hair treating device.

In this sixth embodiment, a step is provided at each side of the body 301, as shown in FIGS. 14 and 15 with which a base portion 306 of an elastic porous absorbing member 305 shown in FIG. 16 is bonded. In this embodiment there are multiple rows 308 of comb teeth 302.

Figure 17:
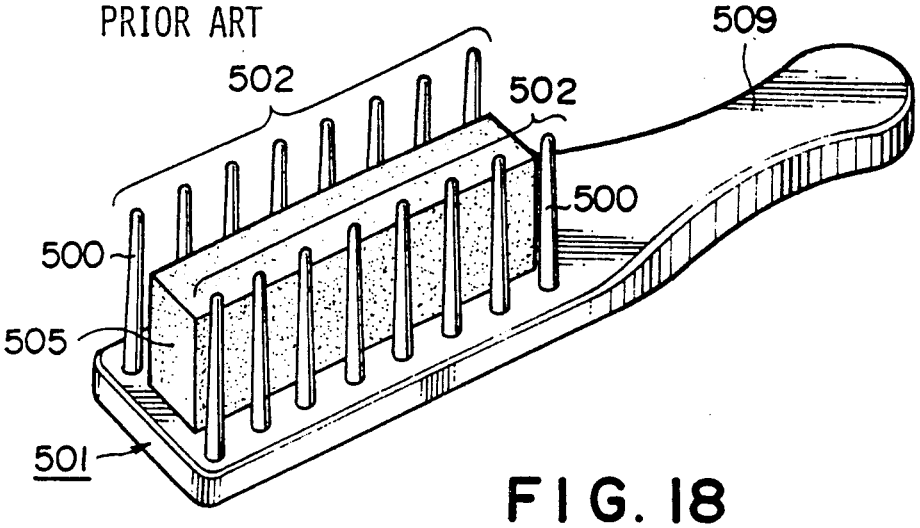
FIG. 17 PRIOR ART
FIG. 17 is a perspective view showing a conventional hair treating device.
Figure 18:
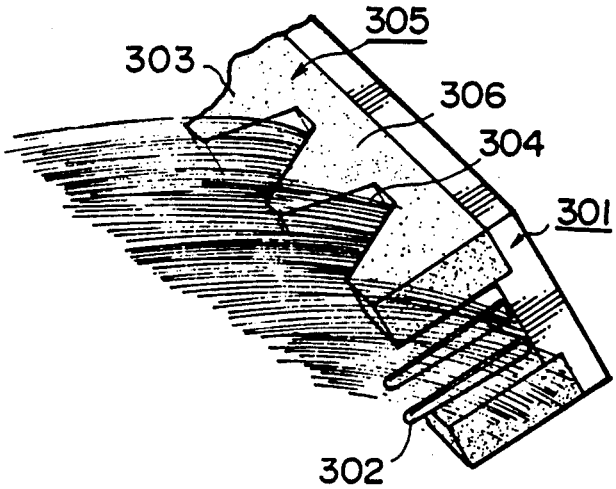
FIG. 18 is an explanatory view showing the fifth embodiment of the hair treating device according to the present invention, shown in FIG. 14, which is in use.
Figure 19:
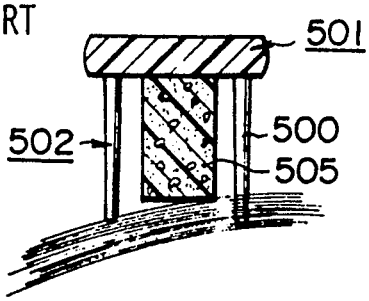
FIG. 19 PRIOR ART
FIG. 19 is a cross-sectional view of the conventional hair treating device of FIG. 17 which is in use.

With reference to FIGS. 17 to 19, a comparison of the use of the hair treating device of the present invention and a conventional device is made.

FIG. 17 is an example of a conventional device in which two comb tooth rows 502 consisting of teeth 500 are mounted at both sides of a body 501, which is formed integrally with a handle 509. In the center between the rows 502 an elastic porous absorbing member 505 is provided which has no teeth. This example is similar to Japanese Utility Model Applications Laid-Open under No. 101028/1981 and No. 99530/1983.

FIG. 18 is a perspective view of the sixth embodiment of the present invention shown in FIGS. 14, 15, and 16 when in use. FIG. 19 is a view showing the state of use of the conventional device shown in FIG. 17, which is given for the purpose of comparing the conventional device and the device of the present invention.

In the conventional device, as clearly shown in FIG. 19, only the surface of the hair touches the surface of the elastic porous absorbing member 505.

On the contrary, according to the present invention, a tooth 303 of the elastic porous absorbing member 305 defines sufficient spaces between neighbouring teeth 303 and the pitch between teeth of the absorbing member 305 are sufficiently larger than those between comb teeth, so that sufficient combing of the hair with the comb teeth can be made. Also, the hair can touch the sides of the teeth 303 of the absorbing member 305.

By sufficiently impregnating elastic porous absorbing member 305 with water, the hair may be wetted and the disorderly hair after sleep can be reformed.

Likewise, cleaner or hair tonic, etc. may easily be applied to the hair treating device according to the present invention.

Using dry absorbing members, moisture of the wet hair or dirty moisture of the hair may be absorbed.

According to the present invention, the elastic porous absorbing member may be exchanged easily.

Many modifications are possible to the described embodiments within the scope of the invention.

If combing is contemplated, not any one row of comb teeth of the absorbing member but several rows thereof may be provided.

An elastic porous absorbing member which has teeth at both upper and lower sides thereof may independently be used, without comb body portion, when only the absorbing member is used for applying a liquid agent.

What is claimed is:

1. A hair treating device comprising:

(a) a body having at least one row of comb teeth;

(b) at least one elastic porous absorbing member having teeth formed of a concave and a convex portion, the pitch between neighboring teeth being sufficiently wider than those between neighboring comb teeth of the body; and (c) a connecting structure for supporting the elastic porous absorbing member at an outer side of and in parallel with the row of comb teeth, wherein the connecting structure for the elastic porous absorbing member is a slot or a step provided at one outer side or both outer sides of the rows of comb teeth and the elastic porous absorbing member is fixed so that teeth thereof are in parallel with the rows of comb teeth.

2. A hair treating device comprising:

(a) a body made of synthetic resin and having at least one row of comb teeth;

(b) at least one elastic porous absorbing member having teeth formed of concave and convex portions, the pitch between neighboring teeth of said absorbing member being greater than the pitch between neighboring comb teeth of the body;

(c) a connecting structure for supporting the elastic porous absorbing member at an outer side of and in parallel with the row of comb teeth, the connecting structure including a plurality of rows of shafts integrally formed with the body; and (d) a head disposed on each said shaft and at an outer side of the comb teeth of the body, the elastic porous absorbing member having at least one row of engaging holes, which are smaller than the heads of the shafts, the elastic porous absorbing member being engageable with and detachable from the body.

3. A hair treating device according to claim 2, wherein the heads are integrally formed with the shafts.

4. A hair treating device according to claim 2, wherein the head portions are formed separately from and connected with the shafts.

5. A hair treating device according to claim 2 wherein each of the shafts has a longitudinal axis, and the heads extend substantially perpendicularly with respect to the longitudinal axes of the shafts.

6. A hair treating device according to claim 2, wherein the elastic porous absorbing member has means for defining slots, the slot means receiving ends of the shafts.

7. A hair treating device according to claim 2, wherein the connecting structure for the elastic porous absorbing member further includes protrusions on the body, the protrusions being engaged with grooves provided at ends in the longitudinal direction of the elastic porous absorbing member.

* * * * *